United States Patent [19]

Stelter et al.

[11] 3,930,318

[45] Jan. 6, 1976

[54] ULTRAVIOLET CURING MACHINE

[75] Inventors: Ronald B. Stelter, Country Club Hills; Raymond Kulka, Chicago; Paul J. Kmetty, Bartlett, all of Ill.

[73] Assignee: Continental Can Company, Inc., New York, N.Y.

[22] Filed: Apr. 23, 1973

[21] Appl. No.: 353,855

[52] U.S. Cl. ..... 34/4; 34/41; 34/49; 250/215; 219/405

[51] Int. Cl.[2] ..... F26B 3/28

[58] Field of Search ..... 34/1, 4, 18, 41, 151, 49; 250/452, 454, 492, 493, 503, 504, 514, 223, 215; 219/388, 216, 405, 411

[56] References Cited

UNITED STATES PATENTS

| | | | |
|---|---|---|---|
| 1,802,407 | 4/1931 | Danninger et al. | 162/192 |
| 1,985,563 | 12/1934 | Fitz Gerald | 250/215 |
| 2,438,365 | 3/1948 | Hepp et al. | 250/215 |
| 2,640,277 | 6/1953 | Dungler | 34/162 |
| 2,664,282 | 12/1953 | Mann | 263/37 |
| 2,680,304 | 6/1954 | Herbert | 219/388 |
| 2,861,354 | 11/1958 | Hultgreen | 34/68 |
| 3,114,822 | 12/1963 | Boland | 219/405 |
| 3,234,475 | 2/1966 | Giormaine et al. | 250/504 |
| 3,240,915 | 3/1966 | Carter et al. | 219/405 |
| 3,321,197 | 5/1967 | Parslow | 34/41 |
| 3,364,594 | 1/1968 | Gruver | 34/162 |
| 3,504,614 | 4/1970 | Lyons et al. | 34/162 |
| 3,510,664 | 5/1970 | Nichols | 250/223 |
| 3,637,983 | 1/1972 | Nelson | 34/49 |
| 3,643,342 | 2/1972 | Tyson et al. | 34/48 |
| 3,718,983 | 3/1973 | Crowell | 34/156 |
| 3,730,633 | 5/1973 | Kennedy | 250/222 |
| 3,733,709 | 5/1973 | Bassemir | 34/4 |
| 3,745,307 | 7/1973 | Peek et al. | 34/4 |
| 3,792,260 | 2/1974 | Stewart et al. | 250/215 |

*Primary Examiner*—Wendell E. Burns
*Assistant Examiner*—Paul Devinsky
*Attorney, Agent, or Firm*—Diller, Brown, Ramik & Wight

[57] ABSTRACT

This invention relates to a conveyor for transporting sheets of material through an ultraviolet exposing chamber for curing and setting of a coat. Up to this time, the drying of solvent ink has involved considerable pollution problems, a fair consumption of natural gas and large and costly ovens with high temperature incineration systems. These problems have generally been brought about by long ovens wherein the metal sheet has been passed through once or twice in order to accomplish curing or drying.

10 Claims, 5 Drawing Figures

ULTRAVIOLET CURING MACHINE

It is an object of our invention to alleviate pollution problems associated with lithography operations.

It is another object of our invention to lower the energy requirement as compared to conventional lithography machines.

It is another object of our invention to develop a process which gives a surface having a superior adhesion and wear quality.

This invention has solved the problem by the use of solvent-free resins with appropriate sensitizers and pigments which are applied in a semi-liquid form and exposed to a battery of mercury vapor lamps emitting ultraviolet energy. Additional colors may be printed immediately after each ultraviolet exposure, eliminating the present problems of wet-on-wet inks and multiple passes through printing and drying lines in the cases where several colors have been specified.

In the accompanying drawings, we have shown the presently preferred embodiments of the invention in which.

Figures 1, 3:
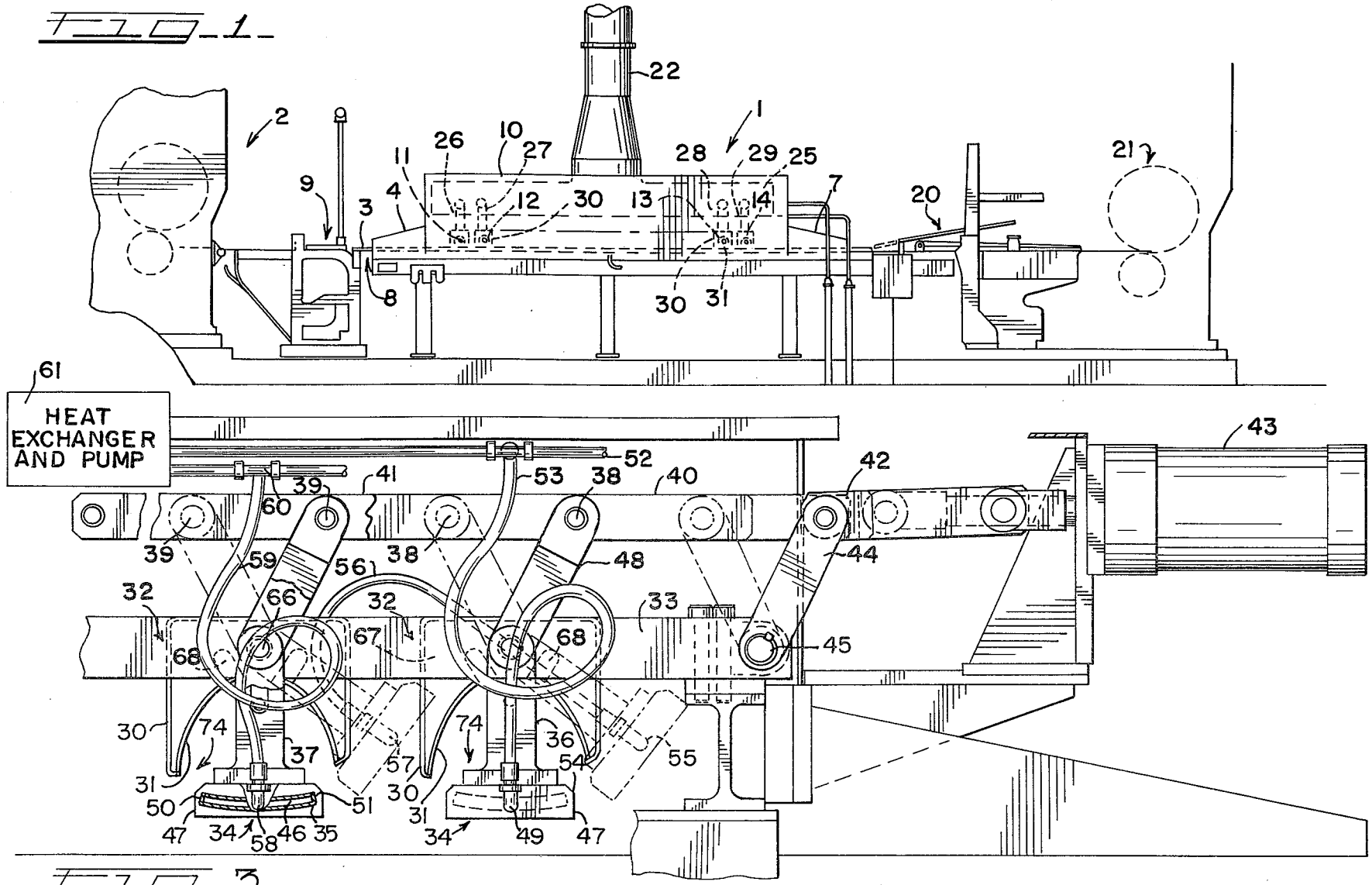
FIG. 1 shows a schematic diagram of our ultraviolet curing machine.
FIG. 3 shows the ultraviolet lamp shutters and linkage which moves these shutters.

Referring now to the drawings in detail, it will be seen that there is illustrated in FIG. 1 an ultraviolet curing oven, generally identified by the numeral 1. To the left of the oven is a press 2 which applies one or more colors of coating material to the upper surface 3 of a metal sheet which is being coated. A particular type of coating material which is proprietary to Continental Can Company, Inc., is utilized. This material is suceptible to curing and drying by ultraviolet light. The coating materials are n the form of in solvent-free resins with appropriate sensitizers and pigments which are applied in semi-liquid form and, when exposed to a battery of mecury vapor lamps which emit ultraviolet energy, cure in less than one second.

Figure 2:
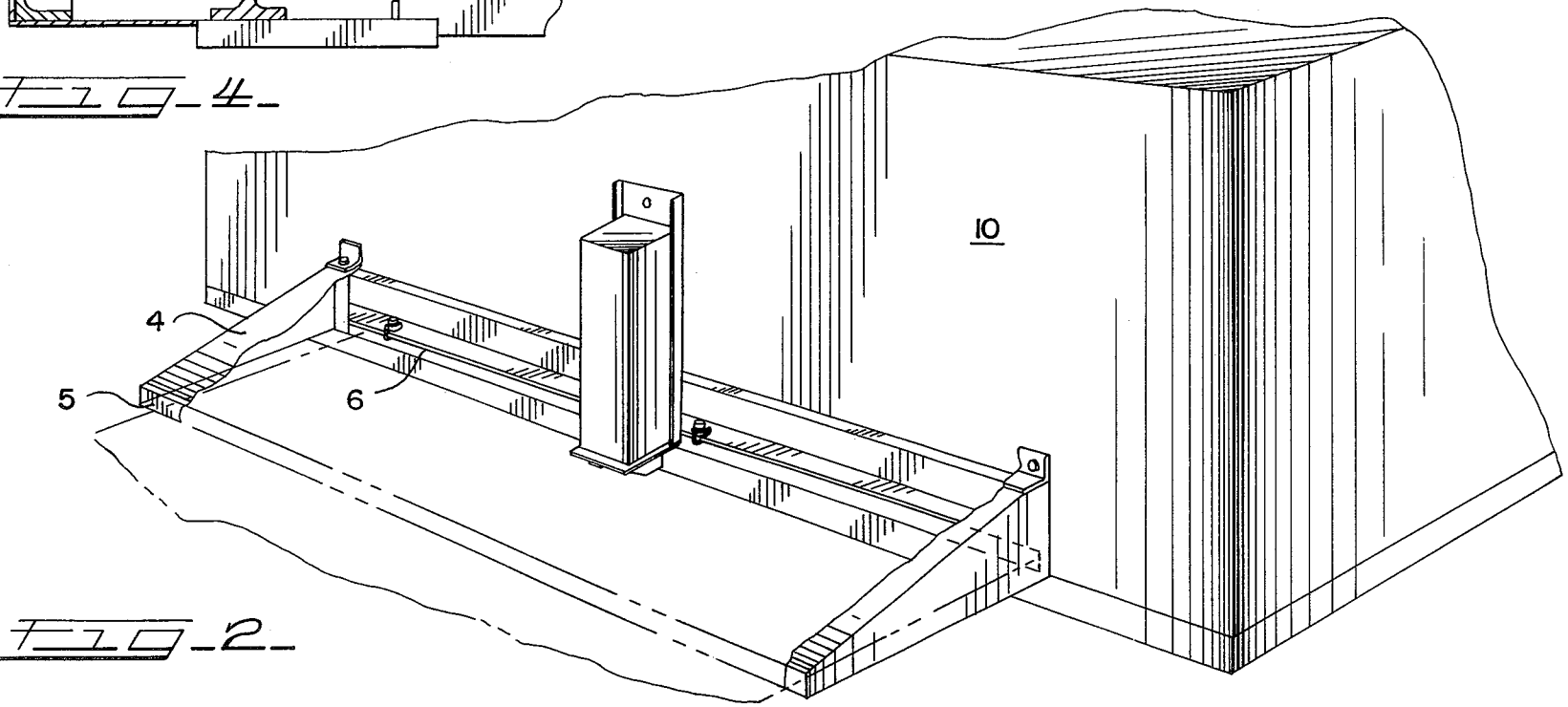
FIG. 2 shows the protective tunnel at both ends of our machine.

The curing oven 1 includes a housing 10 which is provided on that side thereof adjacent the press 2 with a first protective tunnel 4. The tunnel 4 extends about 19 to 21 inches from the housing 10 and has a laterally disposed outer slot 5 of approximately 3/4 inch height and a like disposed inner slot 6 of one and one-quarter inch or less, as shown in FIG. 2. At the opposite end of the housing 10 there is an outlet protective tunnel 7 having similar slots.

It is to be understood that the ultraviolet radiation within the housing 10 is very intense and that the protective tunnels 4, 7 prevent the ultraviolet radiation generated in the oven from emanating to the outside and harming the operator or passer-byers. Further, the tunnels 4, 7 act as protective devices for keeping dust and any other objects from impinging upon the tacky surface of the coated metal sheets in their passage through the oven 1.

It is to be understood that each sheet is moved through the oven 1 by means of a conveyor 8 which may be a chain having dogs. The sheet is moved from a press delivery table 9 into the tunnel 4, then through the oven housing 10, and out through the tunnel 7. After the sheet passes through the protective tunnel 7, it passes onto or under a sample device 20 and to another press 21.

It is to be understood that mounted within the housing 10 is a series of ultraviolet lights of which only left and right terminal lights 11, 12 and 13, 14 are illustrated. It is to be understood that the ultraviolet light system extends completely through the housing 10 and is formed of from 8 to 14 lamps or lights.

Figure 4:
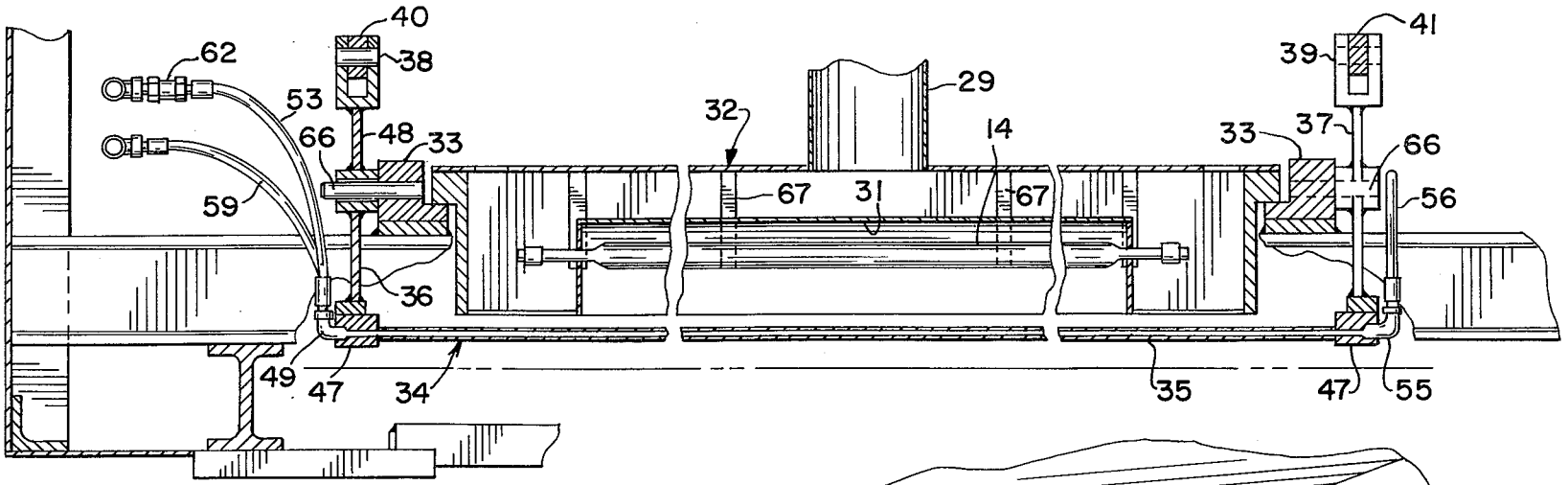
FIG. 4 shows a cross-section view of the lamp housing taken along the line 4-4 of FIG. 3. The view shows the air passages for cooling.
Figure 5:
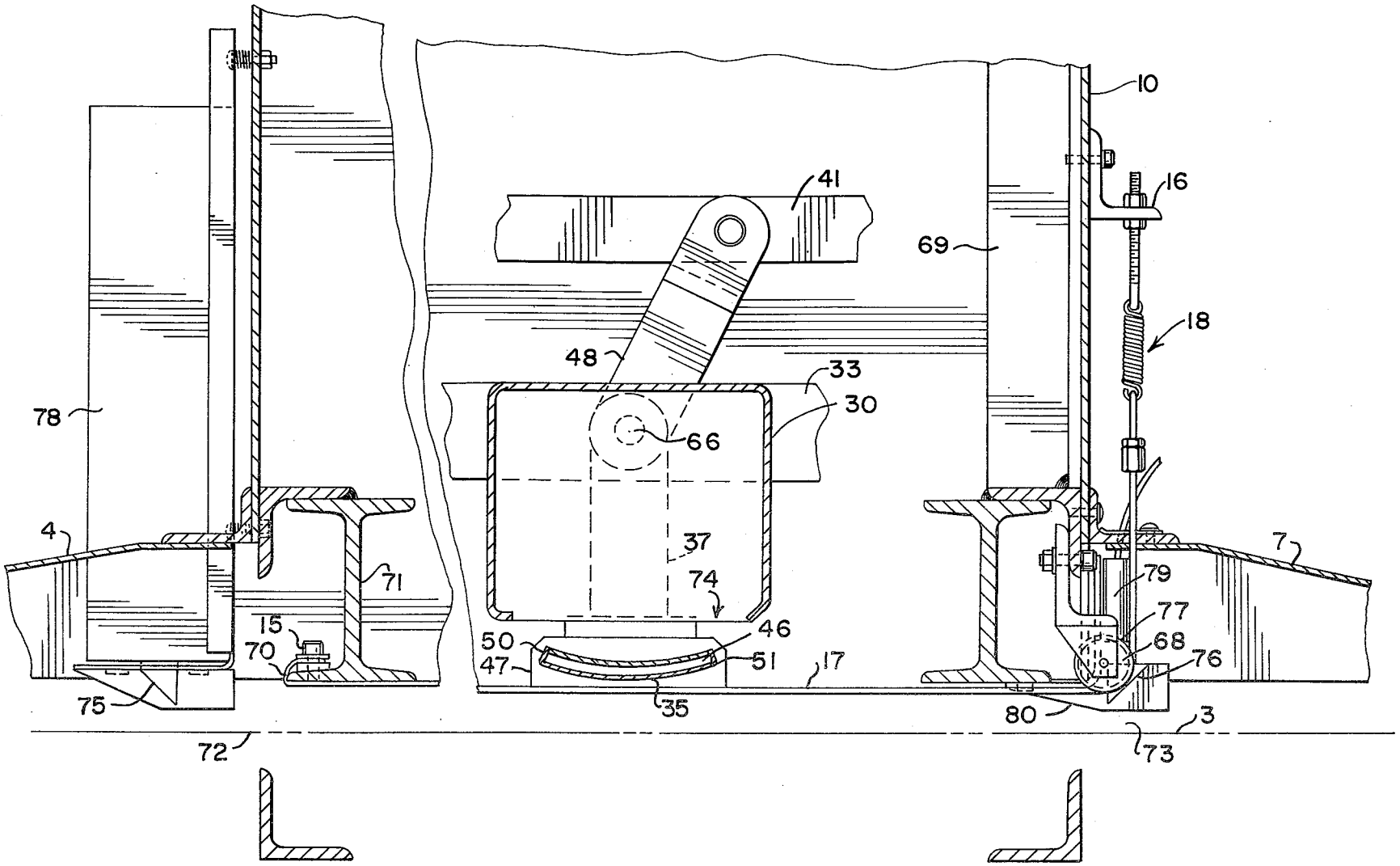
FIG. 5 shows a protective wire fastening and the area of this fastening and a laser system to detect sheet buckling.

Each of the ultraviolet lamps (lamps 11-14) as shown in FIGS. 3, 4 and 5, is part of an ultraviolet lamp assembly 32 which includes a reflector housing 30 having supported therein an elliptical reflector 31. Support brackets 33 extend from one end of the housing 10 to the other end along opposite sides thereof, as is shown in FIG. 4, and support the housing 30.

Referring once again to FIG. 1, it will be seen that a ventilating duct 22 is attached to the top of the housing 10 to provide for the cooling of the interiors of the housings 30 as well as the reflectors 31. The duct 22 has the lower end thereof connected to a manifold 25 shown generally at the top of the inside of the housing 10. The manifold 25 has a plurality of tubes, of which only end tubes 26, 27 and 28, 29 at the opposite ends of the housing 10 are illustrated. The tubes 26–29 extend from the manifold 25 down to the reflector housings 30 of the lamps 11, 12 and 13, 14. As is shown in FIG. 4, the tube 29, for example, is coupled to the housing 30 for the lamp 14 to effect circulation of air around the reflector 31 and withdrawal thereof.

With particular reference to FIG. 3, it will be seen that each reflector 31 is elliptical and serves to concentrate the ultraviolet radiation emanating from its respective mecury arc lamp in a downwardly directed narrow band. THe ultraviolet radiation will be directed onto the coated metal sheets passing from left to right to meet the lamp assemblies 32.

Associated with each lamp assembly 32 is a shutter assembly 34 which, in FIG. 3, is illustrated in its radiation blocking position in solid lines and in its out of the way position in dotted lines. Each shutter assembly 34 includes a shutter 35 which extends between a pair of end support brackets 47, as shown in FIG. 4. The end support brackets 47 are carried by depending arms 36, 37 which are pivotally mounted on the supporting brackets 33 for swinging about pivots 66. The arms 36, 37 include angularly offset upper portions 48 (FIG. 3) which terminate in yokes having pivoted attachments 38, 39 to bars 40, 41, respectively, mounted within the housing 10 above the lamp assemblies 32.

It is to be understood that the bar 40 is a drive bar while the bar 41 is a follower bar. Connected to end portions of the bars 40, 41 are arms 44 which are fixedly carried by a shaft 45 for moving in unison therewith. The drive bar 40 has an end 42 thereof attached to an extensible motor 43.

It is to be understood that with reference to FIG. 3 that in the retracted position of the motor 43, the shutter assemblies 34 are in their positions underlying the lamp assemblies 32 and blocking the ultraviolet radiation from being directed onto coated sheets passing through the oven 1. However, when the motor 43 is extended, the drive bar 40 is moved to the left with the arm 44 thereof assuming the illustrated dotted line position. As a result, the shutter assemblies 34 are swung to positions alongside their respective lamp assemblies 32 wherein they no longer block the ultraviolet radiation.

At this time it is pointed out that when the arm 44 is moved to the left by the like movement of the bar 40, the shaft 45 rotates and moves the other arm 44 to the left with the follower bar 41 moving in the same manner as the drive bar 40.

It is to be noted from FIGS. 3, 4 and 5 that each shutter has a one-way channel 46 for allowing cooling liquid to flow through the shutter. The channel 46 extends the full width of the shutter from edge 50 to edge 51, as well as the full length of the shutter 35 so as to provide for optimum cooling when cool water flows through the channel 46.

It is to be understood that the shutters 35 are cooled in pairs. One shutter 35 has an elbow 49 connected at one end thereof with this elbow being connected to a supply source 52 by means of a flexible conduit 53. The water flows out of the first shutter through a second elbow 55 into a second flexible conduit 56 and then into a second shutter 35 through a third elbow 57. The water flows through the second shutter and out through a fourth elbow 58 which has connected thereto a third flexible conduit 59 which is coupled to a water discharge point 60. The now heated water is circulated through a heat exchanger 61 where it is cooled and then returned for circulation through the shutters. A metering device 62 (FIG. 4) such as the "Measureflo" meter of Hayes Manufacturing Company of Erie, Pennsylvania is located in the flexible conduit 53 between the water supply and the associated shutter. This device ensures an even flow of water through the shutters.

Extending above the conveyor 8 through the housing 10 below the shutters 35 are a plurality of wires 17. These wires are safety wires and serve to protect the shutters 35 and the lamp assemblies 32 against engagement therewith by the metal sheets passing through the oven 1. It is to be understood that the metal sheet may warp upwardly and thus could possibly come into engagement with the shutters or the lamp assemblies. The safety wires 17 are secured in place by fittings 15, 16 (FIG. 5). The mounting of the protective wires 17 will be described in more detail hereinafter.

As can be readily seen, the width of each shutter 35 is not enough to completely cover the reflector opening 74 (FIG. 3). The shutter 35 also lies in a plane below the reflector opening 63. In this way, air may freely flow around the inside of the ultraviolet reflector 31 and on the inside of the shutter. This cooling aids somewhat in keeping the mercury arc lamp assembly 32 from growing unduly hot. In fact, the lateral flow of air with this arrangement will be just about the same amount as it was when the shutter was open. However, when the shutter is swung under the reflector and its housing, air circulates and the shutter blocks 90% or more of the ultraviolet light from radiating out of the reflector. This is because of the ultraviolet radiation is concentrated in the center area of the reflector opening although some ultraviolet leaks out between the shutter and the shutter housing. The shutter 35 itself is water cooled and the reflector 31 and reflector housing 30 are air cooled. The shutter 35 is swung about pivot 66 on the lamp housing 30 and when lifted to the open position is stored in the space between the lamp assemblies 32.

When the shutter 35 is pivoted on the reflector housing 30 as shown in FIGS. 3, 4 and 5, the shutter occupies minimal space as compared to the alternative method of shutter withdrawal where the shutter is withdrawn in a straight lateral line.

The shutter 35 itself extends between the end supports 47 and its contour is a segment of an arc. As pointed out in connection with the cooling apparatus, the shutter is hollowed. The shutter drive bar 40 connects to each of the shutter arms and the shutters are designed to be swung in unison so that the emission from all ultraviolet lamps is cut 90% at the same time. When one shutter swings to allow full radiation from the lamp assembly, then all shutters allow full radiation. All shutters are in the same position at a given time. The air tubes 26–29 and manifold 25 lie above the ultraviolet section of the ultraviolet lamp system shown in FIGS. 1 and 4.

Details of the lamp housing 32 are shown in the cross-section view of FIG. 4. The lamp housing 32 is of sheet metal made in the general shape of an open sided polygon. Each end is closed and along the length of the reflector 31 are spaced stiffening elements 67 between the lamp housing and the reflector. The air tube 26 is connected to the center of the housing and draws cooling air through the housing and through the lateral slots 68 shown in the stiffeners 67. In this way, the back surface of each reflector is kept relatively cool and the housing and stiffeners 67 themselves are cooled by the cooling flow of air.

In a system such as this where sheets of metal are passed through the hot oven, various parts of the sheets 3 of metal may heat unevenly or may have different coefficients of linear expansion with temperature. For whatever reason, they sometime tend to buckle. In order to avoid damage to the mechanism or the interior of the oven, a protective device has been installed in FIG. 5. If the sheets of metal curl or buckle, one or more of them might well catch on some structure inside the oven. Oncoming sheets of metal which may be pushed by dogs will pile up inside the oven and a very serious jam inside the oven may ensure. In this event, damage to the shutters 35, housing 30, reflectors 31 and other elements of the oven is almost sure. To avoid the possibility of pile up or damage to the interior of the oven, several wires 17 are strung along the length of the oven approximately one inch above the conveyor line.

The protective device shown in FIG. 5 is a wire 17 fastened at the one end to the entrance of the oven and extending through the oven above the conveyor line. Wire 17 then passes over a pulley 68 which is mounted at the exit to the oven. The free end of each wire 17 is attached to a tension spring 18 which itself is attached to an upper fastening 16 mounted on the frame 69 of the oven. In practice, three wires are used and extend the length of the oven 1. However, a larger number may be used depending upon the width of the oven. The first end 70 of the wire is attached to a frame member 71 at the entrance 72 of the oven and extends underneath the ultraviolet lamp system to the exit 73 of the oven. Each mercury arc lamp assembly 32 may be placed closer to the work because the mercury arc lamp assembly and the shutters 35 are now protected from damage which would occur if the sheet buckled and struck the assembly. The mercury arc lamp assembly 32 is positioned above the wires at a distance such that the hollow shutter 35 may be swung on its pivot to a position below the opening of the mercury arc lamp assembly without striking wires 17. In the event of a jam or other work stoppage, shutter 35 is swung down over the entrance of the opening 74 in the mercury arc lamp assembly. This presents continued heating, to an appreciable extent, of the sheet of metal which may be stationary underneath the lamp assembly. The protective wire 17 restrains the metal sheet from lifting upward and damaging the shutter or other apparatus.

Screw jacks (not shown) are provided at the corners of the housing to raise the housing. In this way, access is provided to the interior of the housing in the event of blockage of the sheets or any other reason for desiring to gain access to the interior of the housing.

The sheet slides on hollow rails which have water cooling passing through the rails. The sides and bottom of the oven have water cooled shields for conducting the heat away from the oven.

An additional protective feature is a laser beam or other monochromatic light which is aimed to pass along the length of the conveyor and a small distance above the conveyor. The laser beam passes about ½ an inch to ¾ above the conveyor and operates as a detector. Right angle prisms 75, 76 are mounted at the entrance 72 and exit 73 of the oven. These prisms 75, 76 are mounted so that the radiant energy beam which travels parallel to the conveyor first travels parallel to the end of the oven 1, turns through a right angle, passes through the oven and turns through another right angle. A high energy laser beam is used because a variety of radiant energy frequencies are generated in the interior of the oven. However, the laser beam has only one frequency. A filter 77 is placed in the path of the laser beam to ensure that it is monochromatic. A red filter such as filter 6-1031-3 purchased from Photo Switch Division, Electronics Corporation of America, Cambridge, Massachusetts may be used. Thus, the laser beam is generated by a laser gun 78 is then reflected through a right angle prism 75, then through a second right angle prism 76 and then the beam passes into a photoelectric cell 79 through a restrictive orifice at 77. Prism 76 is facing the direction of the laser beam and a hood 80 limits the amount of incident radiation which may fall onto the right angle prism 76 and be directed upwardly to the photoelectric cell. Thus, the photoelectric cell 79 is affected almost entirely by only the presence or absence of the laser beam. Since the laser beam is of high intensity, a relatively small interruption of the laser beam by a buckling sheet of metal causes a diminution of output from photoelectric cell 79. The photoelectric cell 79 may be run at less than saturation. For this reason, the detector circuit can be set at whatever level is desired to operate circuits or motors to stop the conveyor, move the shutters or whatever function is desired when a buckling of a certain magnitude is detected. It is to be understood that the photoelectric cell 79 will be coupled to the circuits or motors in any well known and conventional manner and no attempt has been made herein to specifically disclose such a connection in that such connections have been well devq oped in the prior art. As an example reference is here made to U.S. Pat. No. 1,985,563 granted to Allen S. Fitz Gerald on Dec. 25, 1934, and entitled CONTROL SYSTEM FOR ESCALATORS, CONVEYOR, AND THE LIKE. In practice, a NeHe Laser System such as Model S-101 manufactured by C. W. Radiation, Inc. of 111 Ortega Avenue, Mountain View, California 94040 is used. This system generates a visible red beam with a wave length of about 6328A.

Some advantages of this apparatus are partial elimination of dust from the apparatus, retractable shutters, alleviates pollution problems, shortens the length of the printing and curing line and reduces the amount of energy used in printing and curing.

We claim:

1. A curing machine for ultraviolet setting of printing on metal sheets comprising a housing defining curing and setting chamber, conveyor means for transporting sheets in sequence through said chamber a plurality of ultraviolet radiation assemblies within said chamber side-by-side spaced relation transversely of said conveyor means and opposing said conveyor means for emanating ultraviolet radiation along a predetermined path onto metal sheets carried by said conveyor, and shutter means associated with each assembly for selectively blocking at least a portion of ultraviolet radiation from being directed towards said conveyor, said shutter means including a shutter, and mounting means mounting said shutter for swinging movement between a blocking position between the respective assembly and said conveyor and an inoperative position along the respective assembly, each shutter having a passageway extending from one end of said shutter to the other for the passage of a cooling fluid for said shutter, and means for directing a cooling fluid through said passageway.

2. The curing machine of claim 1, wherein said assembly housing encloses said reflector and forms therewith a separate fluid passage, and cooling means connected to said assembly housing for circulating a cooling fluid through said separate fluid passage to cool said reflector.

3. The curing machine of claim 1, wherein each shutter is of a tubular construction defining said passageway.

4. A curing machine for ultraviolet setting of printing on metal comprising a housing defining curing and setting chamber, conveyor means for transporting sheets in sequence through said chamber a plurality of ultraviolet radiation assemblies within said chamber side-by-side spaced relation transversely of said conveyor means and opposing said conveyor means for emanating ultraviolet radiation along a predetermined path onto sheets carried by said conveyor, and shutter means associated with each assembly for selectively blocking at least a portion of ultraviolet radiation from being directed towards said conveyor, said shutter means including a shutter, and mounting means mounting said shutter for swinging movement between a blocking position between the respective assembly and said conveyor and an inoperative position along the respective assembly, said mounting means including a fulcrum at each end of each ultraviolet radiation assembly, an arm pivotally mounted on each fulcrum, said arms being arranged in pairs and including first ends between which a respective shutter extends and to which said respective shutter is secured for swinging about said fulcrums, and at least one arm of each pair of arms being connected to a bar, and means mounting said bar for reciprocal movement for effecting swinging and positioning of said shutter.

5. The curing machine of claim 4, wherein said bar is connected to one arm of each of said plurality of shutters for moving and positioning all of said shutters in unison.

6. The curing machine of claim 4 wherein a remote actuator is connected to said bar for effecting selected reciprocation thereof.

7. The curing machine of claim 4 wherein each ultraviolet radiation assembly includes a housing, a reflector supported from said housing, and said fulcrums are carried by said assembly housings.

8. A curing machine for ultraviolet setting of printing on metal comprising a housing defining curing and setting chamber, conveyor means for transporting sheets in sequence through said chamber a plurality of ultraviolet radiation assemblies within said chamber side-by-side spaced relation transversely of said conveyor means and opposing said conveyor means for emanating ultraviolet radiation along a predetermined path onto sheets carried by said conveyor, and shutter means associated with each assembly for selectively blocking at least a portion of ultraviolet radiation from being directed towards said conveyor, said shutter means including a shutter, and mounting means mounting said shutter for swinging movement between a blocking position between the respective assembly and said conveyor and an inoperative position along the respective assembly, each ultraviolet radiation assembly including a housing, a reflector supported from said housing, and said mounting means being carried by said assembly housing and mounting said shutter on said assembly housing independently of said reflector, the ultraviolet radiation assembly including an ultraviolet radiation source, said reflector having an opening through which ultraviolet radiation emanates, said shutter being of a length greater than said ultraviolet radiation source and of a configuration to at least partially cover said opening in said reflector when said shutter is in its closed position, said mounting means including at least a pair of fulcrums mounted at opposed ends of each of said assembly housings; at least a first and a second arm each having a first end and a second end; each said arm being pivoted on a fulcrum; a first drive bar; a second drive bar; means connecting said first end of said first arm to said first drive bar; means connecting said second end of said first arm to said shutter; means connecting said first end of said second arm to said second drive bar; and means connecting said second end of said second arm to said shutter whereby reciprocation of said first and second bars causes said shutter to move from open to shut position and visa versa.

9. A curing machine for ultraviolet setting of printing on metal as set forth in claim 8, in which said mounting means further comprises:

a first short arm having a first end and a second end;

a second short arm having a first end and a second end;

a drive shaft mounted in said chamber and extending across the conveyor and having a first end and a second end;

means connecting said first end of said first short arm to said first end of said drive shaft;

means connecting said first end of said second short arm to said second end of said drive shaft;

means connecting said second end of said first short arm to said first drive bar; and means connecting said second end of said second short arm to said second drive bar whereby movement of said first drive bar causes movement of said second drive bar and visa versa.

10. A curing machine for ultraviolet setting of printing on metal comprising a housing defining curing and setting chamber, conveyor means for transporting sheets in sequence through said chamber a plurality of ultraviolet radiation assemblies within said chamber side-by-side spaced relation transversely of said conveyor means and opposing said conveyor means for emanating ultraviolet radiation along a predetermined path onto sheets carried by said conveyor, and shutter means associated with each assembly for selectively blocking at least a portion of ultraviolet radiation from being directed towards said conveyor, said shutter means including a shutter, and mounting means mounting said shutter for swinging movement between a blocking position between the respective assembly and said conveyor and an inoperative position along the respective assembly, each shutter having a passageway extending longitudinally therethrough for allowing cooling fluid to flow through said shutter and each passageway having a first end and a second end, a first fluid conduit means for conducting fluid from a fluid source to a first end of said passageway in a first shutter; a second fluid conduit means for conducting fluid from said second end of said passageway in said first shutter to a first end of a passageway in a second shutter; and a third fluid conduit means for conducting fluid from a second end of a passageway in a second shutter to a discharge point.

* * * * *